US006699011B2

(12) United States Patent
Cot et al.

(10) Patent No.: US 6,699,011 B2
(45) Date of Patent: Mar. 2, 2004

(54) LINKING ARRANGEMENT OF A TURBINE STATOR RING TO A SUPPORT STRUT

(75) Inventors: Fabrice Michel Olivier Cot, Savigny le Temple (FR); Alain Dominique Gendraud, Vernou la Celle sur Seine (FR); Philippe Jean-Pierre Pabion, Vaux le Penil (FR)

(73) Assignee: SNECMA Moteurs, Paris (FR)

( * ) Notice: Subject to any disclaimer, the term of this patent is extended or adjusted under 35 U.S.C. 154(b) by 183 days.

(21) Appl. No.: 09/976,143

(22) Filed: Oct. 15, 2001

(65) Prior Publication Data

US 2002/0048512 A1 Apr. 25, 2002

(30) Foreign Application Priority Data

Oct. 19, 2000 (FR) ..... 00 13355

(51) Int. Cl.[7] ..... F01D 11/08
(52) U.S. Cl. ..... 415/173.1
(58) Field of Search ..... 415/173.1, 173.4, 415/173.5, 115, 116

(56) References Cited

U.S. PATENT DOCUMENTS 4,676,715 A 6/1987 Imbault et al.
4,687,413 A 8/1987 Prario
5,018,941 A 5/1991 Heurtel et al.
5,197,853 A 3/1993 Creevy et al.
5,205,708 A * 4/1993 Plemmons et al. ..... 415/173.1
5,562,408 A * 10/1996 Proctor et al. ..... 415/173.1
5,593,276 A * 1/1997 Proctor et al. ..... 415/173.1
6,575,697 B1 * 6/2003 Arilla et al. ..... 415/173.1

FOREIGN PATENT DOCUMENTS

EP 0 334 794 9/1989
EP 0 945 597 9/1999

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, PC

(57) ABSTRACT

A strut (1) fixed to a main portion of turbojet stator carries a ring (5) by a pair of hooks (4, 6) on one side and joining lips (7 and 8) on the other side. In accordance with the invention, the seal is made on the flat sides (10, 11) adjacent to the lips by elastic deflection of the tabs (13) pushing back one of the lips (7). The tabs (13) can also determine the tangential positioning of the ring (5).

4 Claims, 2 Drawing Sheets

LINKING ARRANGEMENT OF A TURBINE STATOR RING TO A SUPPORT STRUT

BACKGROUND OF THE INVENTION

The subject of this invention is an arrangement linking a turbine stator ring to a strut used for supporting this ring.

Turbine stators often include rings, consisting of a number of circle arc segments, the function of which is to delimit the gas circulation jet. These rings are supported and immobilized by struts linking to a main portion of the stator.

We are interested here with the seal between portions of the strut and the rings placed in contact which delimit cavities. The latter are generally the seat of a cooling air outlet which allows the ring to resist the hot gases of the jet, whilst regulating its diameter and the play which it has with the blades of the rotor which turn in front of it. The consequence of air leaks outside the cavities through the surfaces in contact with the ring and the strut is a loss of efficiency of the machine since an additional quantity of air must be taken in for cooling and since the leaks may be mixed with the gases in the jet, the temperature and pressure state of which is different.

In a design developed in U.S. Pat. No. 5,197,853, the ring segments are mounted in the strut by a hinge movement: the ring segments and the strut have additional hooks on one side, which may interlock into one another, establishing a seal thanks to a fitting; they still have lips on the opposite side, which are approached to one another by turning the hooks. When the lips are in contact a calliper is installed to keep them tightly in position. An effort is made to establish a seal on this side by a direct contact of the surfaces of the lips, without using a fitting. In this previous patent, the lip of the strut is divided into two circular and parallel portions, called rails, by a recess and is lodged in a recess of the ring lip of the same width as it, such that the external lateral sides of the rails must establish the seal against the lateral sides of the ring recess. The reality is probably not so satisfactory since only a tightening of the rails in a ring recess of slightly lower width would guarantee that sealing contact was maintained, but it would then been too difficult to mount the ring. It is thus accepted that the ring recess is slightly wider than the strut lip, leaving the plays between the lateral sides and leaks. Nor can any perfect seal be made by contact between the bottom sides of the strut lip and the ring recess, which are curved with radii which do not coincide well, since the heating and the dilatations often differ while the machine operates. For this reason the applicant recommended, according to a patent application which has not yet been published, that the seal should be replaced in these two pairs of surfaces by a seal on a single pair of surfaces, here also flat and lateral, of the ring recess and the strut lip. A tongue was added to the strut and engaged behind a small collar which bore the ring's sealing side. Reciprocally the collar entered into a recess present between the tongue and the strut's sealing side; as this recess was narrower than the collar, the tongue deformed and applied a tightening to the collar, which kept both sides of the seal on each other.

Although the system has given satisfaction, it presents the disadvantage that the tongue partially covers the strut's sealing side, which must necessarily be smooth in order for the seal to be good, and thus rules out obtaining this state by a process of rectification, which would be the most favourable course. Other much less favourable processes must thus be used.

In addition, the tightening callipers of the lips with a short angular extension had their central core engaged in the aligned grooves of the lips: this allowed the slides of the rotating ring to be stopped, but adjusting the callipers in two grooves at once was difficult.

SUMMARY OF THE INVENTION

The invention concerns an improved way of obtaining a tightening of two flat sealing surfaces, directed axially, of the ring and the strut. To summarize, in its most general form it concerns an arrangement for linking a turbine stator ring to an annular strut of the ring support, comprising, on one side of the ring and the strut, hooks for mounting the ring on the strut and, on a second side of the ring and the strut opposed axially to first side, sealing sides by mutual support directed axially, and callipers clasping lips, concentric and near the sealing sides, of the ring and the strut, characterized in that one of the lips includes at least one groove sunk in the axial direction, and the other lip includes at least one curved tab penetrating the groove, with one bottom side of the groove causing the tab to be bent in a direction reinforcing the support of the sealing faces.

There can be any number of tabs and grooves to obtain the desired tightening. As they are made in the contact lips, they do not increase the congestion either of the ring or of the strut, and the important advantage results that the tabs and the grooves can be used to keep the position of the rings in the struts also in a tangential direction, by replacing slugs engaged in drill holes used previously to fulfill this single function, but which required additional machining and weakened the structure.

DETAILED DESCRIPTION OF THE INVENTION

Figure 1:
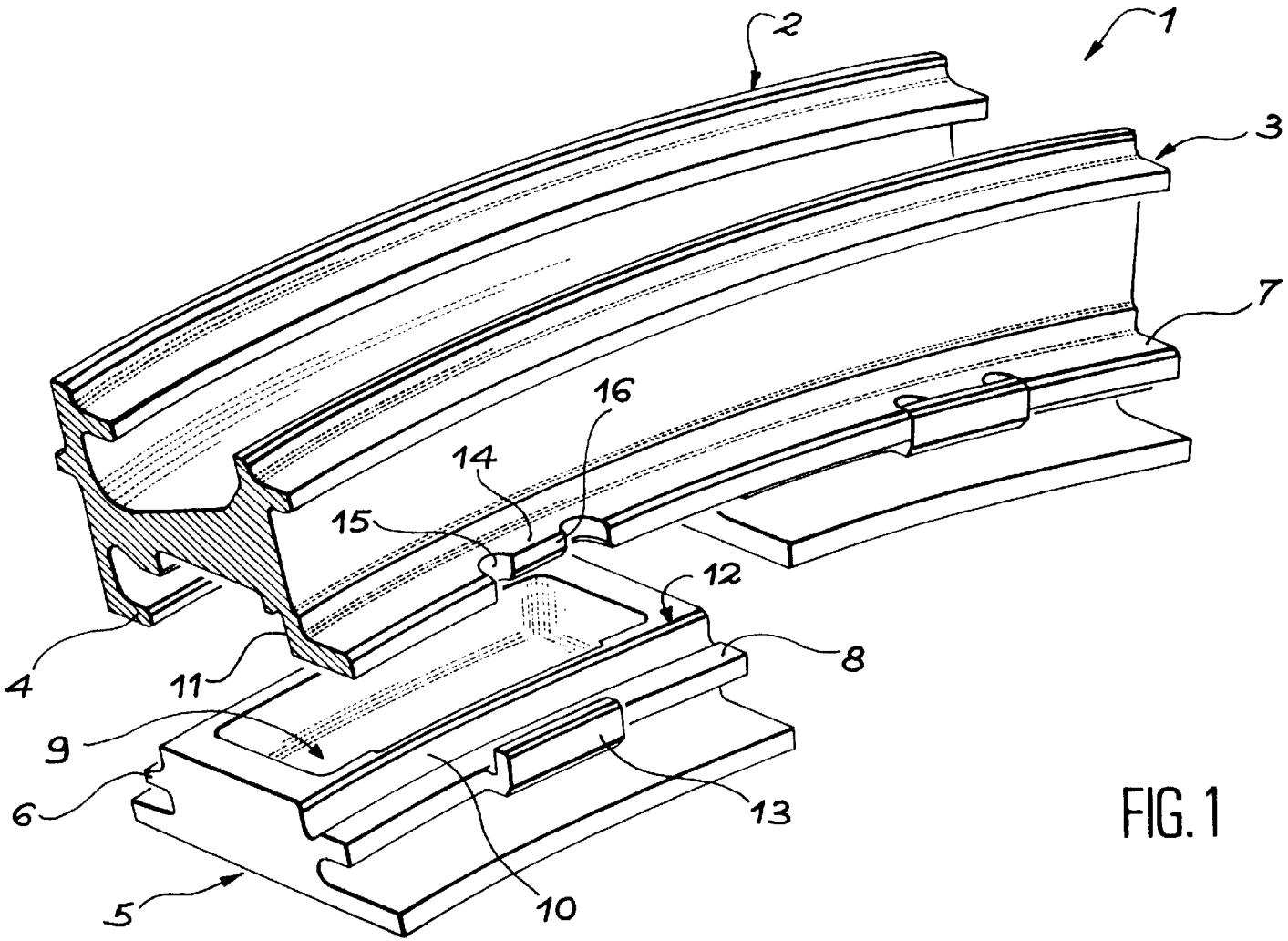
FIG. 1 is a general view of the arrangement of the invention.
Figure 2:
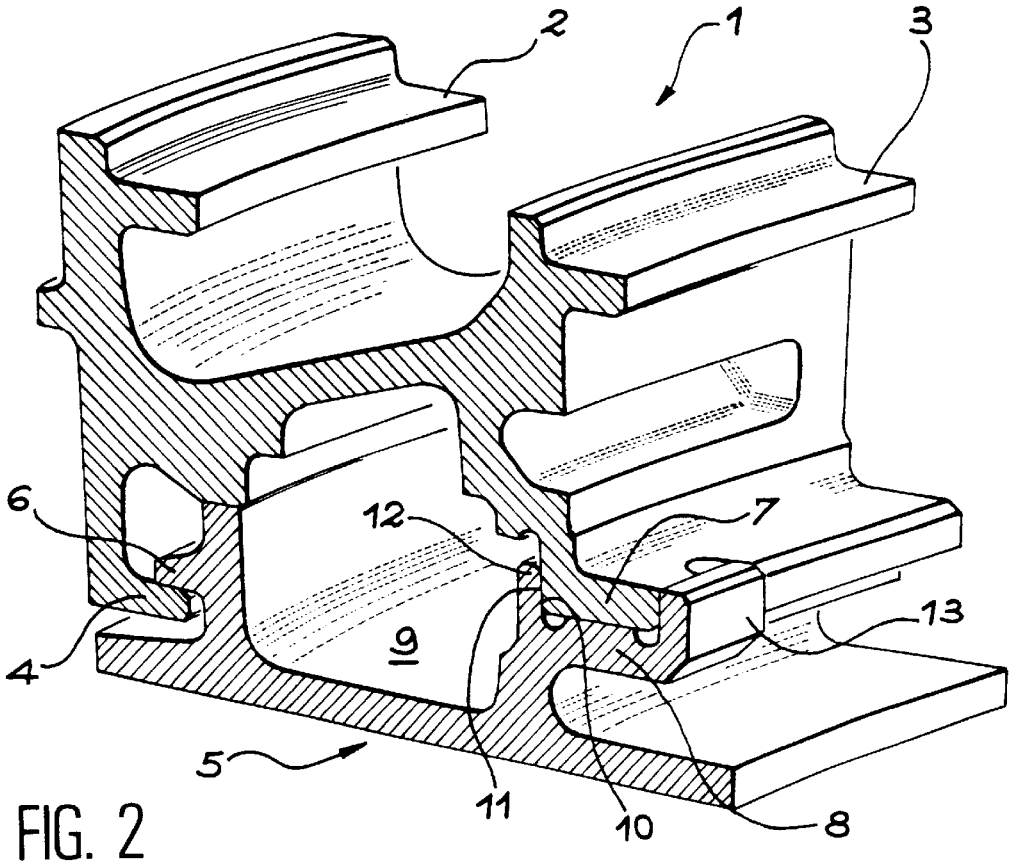
FIG. 2 is a detailed view.

In the figures, a circular strut 1, only a portion of the arc of which is represented, includes upper hooks 2 and 3 for mounting to a main, unrepresented stator portion, and a lower hook 4 used for mounting ring 5 segments by additional hooks 6 to the latter.

Strut 1 and ring 5 still bear, on a side axially opposed to hooks 4 and 6, respective lips 7 and 8 intended to come into contact, with strut 1 and each segment of ring 5 then encompassing a cavity 9 between hooks 4 and 6 and lips 7 and 8, sealing of which must be maintained. This is achieved on the side of lips 7 and 8 by maintaining contact between two flat sides 10 and 11, one located outside an edge 12 rising up on ring 5 behind lip 8, the other behind lip 7 of strut 1. Tabs 13, radially curved towards the outside, are positioned in certain places of lip 8 of ring 5 and are used for pushing lip 7 of strut 1 against edge 12; lip 7 is slightly wider than the space between side 10 of ring 5 and tab 13. Tab 13 is relatively flexible and thus deforms slightly when lip 7 is introduced between it and edge 12. Tab 13 does not, however, rest on the outer edge of lip 7, but on a pin 14 extending at the bottom of a groove 15 of the latter, and on end 16 of which tab 13 presses uniformly. Pin 14 extends over an angularly median portion of groove 15.

The width of tab 13 may be adjusted relative to that of recess 15 in order to be inserted in it with a positive or negative play, compatible with the clearances which are or are not tolerated in a tangential direction between strut 1 and ring 5. No other system, for example using a slug driven into a drill hole, keeps the ring on the strut in a tangential direction.

Figure 3:
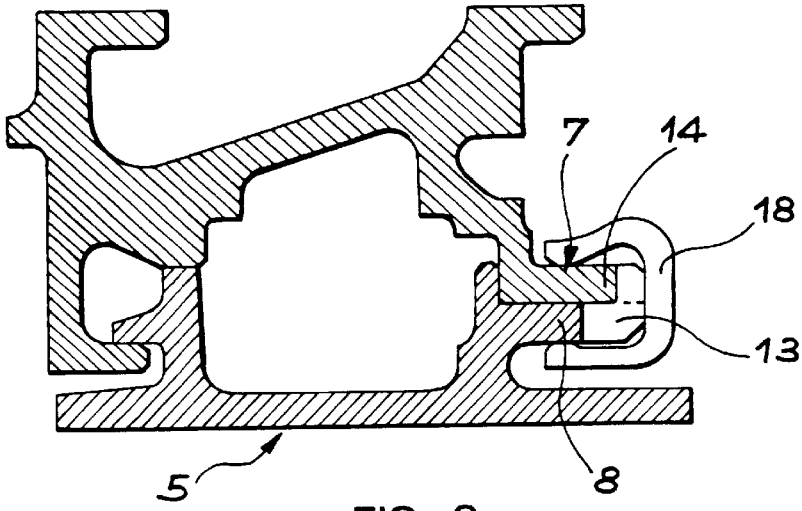
FIG. 3 is a cross-section representing the positioning of the calliper.

FIG. 3 represents calliper 18 used to join lips 7 and 8. It extends over the entire circumference covering the free edges of lips 7 and 8 and tabs 13 where there are any, without any angular adjustment being required; and a regular tightening of the lips is obtained.

Other methods of realization may be envisaged, some of the principles of which are as follows: there could be several tabs 13 in each segment of ring 5; the link in the tangential direction could be ensured by retaining a portion of lip 7 of strut 5 between two tabs 13 rather than by that of a tab 13 between two portions of lip 7; or again, tabs 13 and grooves 15 could be inverted and each borne by the other lip.

Finally, it should be stressed that this design is compatible with a tightened assembly of hooks 4 and 6 one on the other on the opposite side when lips 7 and 8 are mounted. In the American patent mentioned at the beginning, the effect of the substantial frictional forces produced at the junctions between the hooks, in the transitory phases of the machine when the heating and thermal dilatations are different between the ring and the strut, is to prevent here their axial slippages one on the other and to transfer them to the other side of the assembly between the sealing lips, which constantly modifies the configuration of the seal arrangement and may modify the quality of the latter; such slippages are excluded in the invention by the tightening of lips 7 by tabs 13.

What is claimed is:

1. Arrangement to link a turbine stator ring to an annular ring support strut, comprising, on a first side of the ring and the strut, hooks for assembling the ring to the strut and, on a second side of the ring and the strut axially opposed to the first side, sealing sides by mutual support directed axially and a calliper clasping lips, which are concentric and near the sealing sides, of the ring and the strut, characterized in that one of the lips contains at least one groove, sunk in the axial direction, and the other lip contains at least one curved tab penetrating the groove, one bottom side of the groove causing the tab to deflect in a direction reinforcing the support of the sealing sides.

2. Arrangement according to claim 1, characterized in that the bottom of the groove contains a pin which extends outwards towards the tab in an angularly median portion of the groove.

3. Arrangement according to claim 1, characterized in that the tab and groove have widths adjusted to allow a play between them to persist corresponding to a tangential clearance tolerance of the ring in the strut, said tab and said grove keepthe ring in the strut in the angular direction.

4. Arrangement according to claim 1, characterized in that the calliper covers free edges of the lips.

* * * * *